United States Patent [19]

Glennon

[11] 4,118,688

[45] Oct. 3, 1978

[54] CONFIDENCE CHECK CIRCUIT FOR BUILT-IN TEST SYSTEMS

[75] Inventor: Timothy F. Glennon, Rockford, Ill.

[73] Assignee: Sundstrand Corporation, Rockford, Ill.

[21] Appl. No.: 813,998

[22] Filed: Jul. 8, 1977

[51] Int. Cl.[2] ..... G08B 29/00

[52] U.S. Cl. ..... 340/516; 340/52 F; 340/506

[58] Field of Search ..... 340/52 F, 214, 248 R, 340/248 C, 248 B, 248 E, 412, 413, 409

[56] References Cited

U.S. PATENT DOCUMENTS

| | | | |
|---|---|---|---|
| 3,848,241 | 11/1974 | LeNay et al. | 340/214 |
| 3,864,673 | 2/1975 | Thomas et al. | 340/409 X |

*Primary Examiner*—Alvin H. Waring
*Attorney, Agent, or Firm*—Ted E. Killingsworth; Michael B. McMurry; William R. Peoples

[57] ABSTRACT

In order to enhance the reliability of a built-in test system, a confidence check circuit is connected to the logic and condition sensors of the system in order to test for the proper system operation. The confidence check circuit includes a ring counter which sequentially applies check signals of sufficient magnitude to each of the condition sensors to simulate a condition exceeding acceptable system operation limits resulting in the activation of an appropriate failure indicator associated with the built-in test system if the system is operating properly. A check signal is applied to each condition sensor and verification logic within the confidence check circuit responds to the activation of the correct failure indicator by incrementing the ring counter so as to generate a check signal for the next condition sensor in the confidence check sequence. If the correct failure indicator is not activated the ring counter will not be incremented and the confidence check circuit will time out giving an indication of a failure in the built-in test system or the condition sensors.

25 Claims, 5 Drawing Figures

CONFIDENCE CHECK CIRCUIT FOR BUILT-IN TEST SYSTEMS

BACKGROUND OF THE INVENTION

The invention relates to the field of test systems and more particularly to confidence check circuits for use with built-in or self-testing systems.

With the increasing complexity of many technical systems, such as aircraft generator systems, along with increasing reliability standards, many designers are turning to the use of built in or automatic self-testing equipment. Such equipment has the advantage of automatically testing and indicating the nature of failures in a complex system. However, as the systems themselves increase in complexity the circuits required for self-testing also increase in complexity. Thus, the probability is increased that a failure indication may not represent a failure in a particular system but rather a failure in the built-in test systems. As a result it is considered desirable to have some mechanism for checking the reliability of the built-in test system. An example of one such system is provided in Thomas et al. U.S. Pat. No. 3,864,673. What is required is a method of checking the operation of a built-in test system and the associated condition sensors in a comprehensive manner to a very high confidence level.

SUMMARY OF THE INVENTION

It is therefore an object of the invention to provide a confidence check circuit for use with a built-in test system wherein a sequential signal generator within the confidence check circuit sequentially applies check signals to condition sensors within the built-in test system; a failure verification circuit generates a reset signal if a correct failure indicator is tripped by the condition sensor; and an incrementing circuit increments the sequential check signal generator in response to the reset signal.

It is another object of the invention to provide a confidence check circuit for use with a built-in test system wherein a sequential check signal generator sequentially provides check signals to a plurality of condition sensors in the built-in test system; failure verification logic generates a reset signal each time a check signal trips a predetermined failure indicator; the reset signal increments the sequential check signal generator to generate the next check signal in sequence; and a timing circuit generates a protection or test system failure signal if the sequential check signal generator has not generated the complete sequence of check signals within the predetermined time.

It is still another object of the invention to provide a confidence check circuit for use with a built-in test system wherein a ring counter sequentially applies check signals to condition sensors within the built-in test system, failure verification logic generates a reset signal each time a predetermined failure indicator has been tripped by a predetermined check signal; a clock circuit responsive to the reset signal increments the ring counter to generate the next check signal in sequence; an inhibit circuit inhibits the reset signal after the last check signal in the sequence has been generated; and a timing circuit generates a control, protection or test system failure signal in the event that the ring counter is not incremented through the entire sequence of check signals within a predetermined time.

A built-in test or self testing system typically includes a group of condition sensors that might for example in a generating system test for an over voltage in the system or an under frequency condition. Signals which indicate whether or not these conditions exist are then interpreted by a test logic circuit in the built-test system and signals indicating the nature of the failure are utilized to trip failure indicators so that an indication of the nature of the failure is provided. In order to effectively determine whether or not such a test system is operating correctly, the confidence check circuit generates a series of check signals each of which are designed to trip or activate a particular condition sensor in a predetermined sequence. A ring counter is used to generate a series of these check signals in a predetermined sequence wherein each check signal simulates a condition that exceeds acceptable operating limits. Also included in the confidence check circuit is a failure verification logic circuit which compares each individual check signal with the failure signal from the built-in test system. If the output from the built-in test system is correct, the verification logic will generate a reset signal which serves to reset the built-in test logic to its normal state including any failure indicators which may have been tripped. In addition, the reset signal serves to increment the ring counter to the next step of the confidence check thereby generating the next check signal in sequence. The confidence check circuit also includes a timing circuit which is triggered at the same time that the confidence check is initiated. In the event that not all of the check signals in the sequence are generated within a predetermined time as measured by the timing circuit, a failure signal is generated which indicates that there has been a failure in the protection or built-in test system.

DETAILED DESCRIPTION OF THE INVENTION

Figure 1:
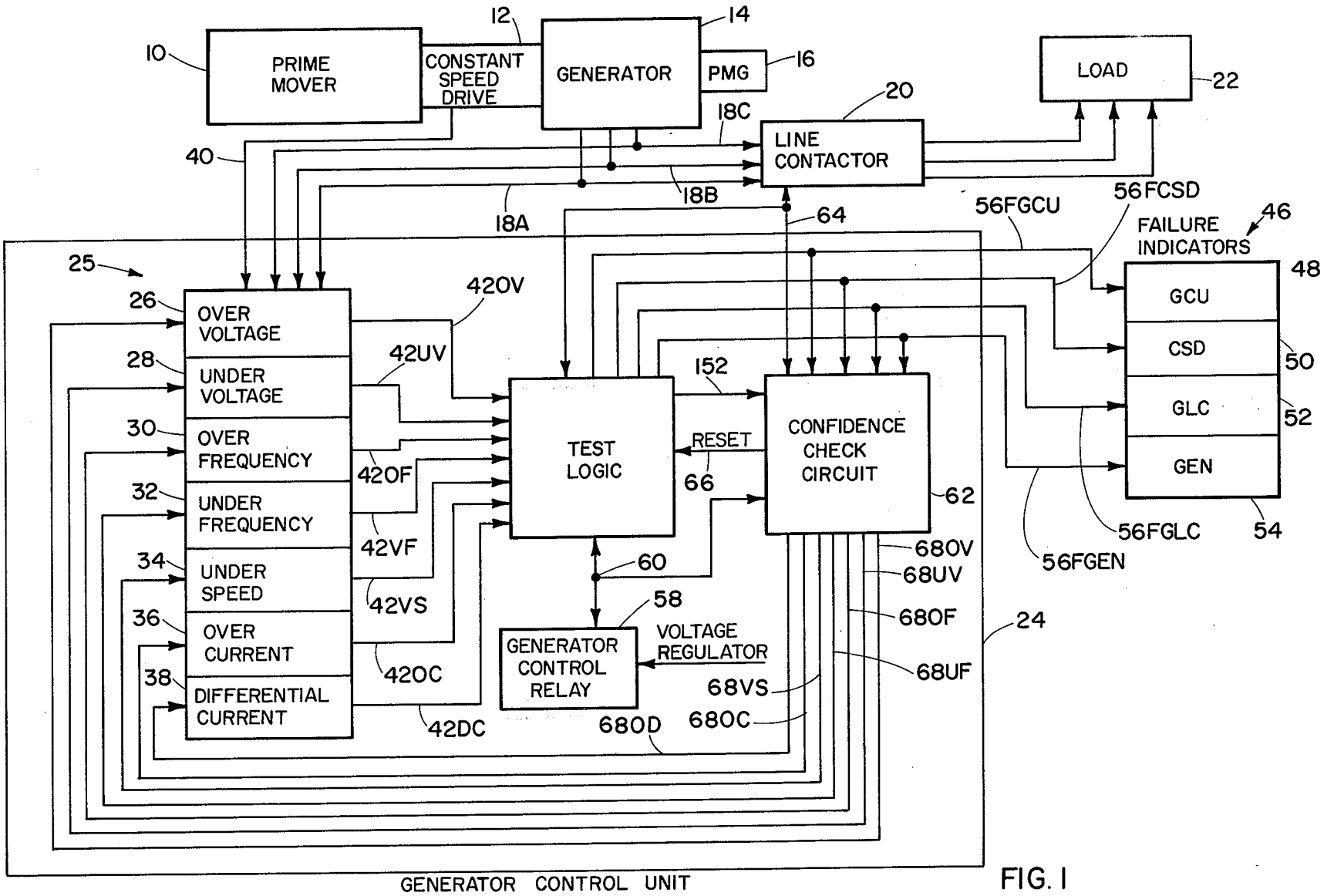
FIG. 1 is a block diagram of a built-in test system for use with a generator system.

In FIG. 1 is illustrated in block diagram form a built-in or self test system including a confidence check circuit for use with a generator system. Although the invention will be described in terms of a built-in test system for a generator system, it will be understood that the basic principles disclosed would find equal application to a wide variety of systems and technologies. As shown in FIG. 1 the generator system includes a prime mover 10 which may be a turbine or any other source of rotational movement, a constant speed drive 12 for rotatably connecting the prime mover 10 to a generator 14. Constant speed drives are typically used in aircraft applications to insure that the rate of rotation of the generator 14 is constant for varying speeds of the prime mover 10. The generator 14 also includes a permanent magnet generator 16 which is typically used in brushless synchronous generators to provide a source of excitation, control, protection and test power. Assuming a three phase generator system, output power from the generator 14 is provided over lines 18A, 18B, and 18C through a generator line contactor 20 to a load 22. As is typical for many generator systems a generator control unit (GCU) indicated within the box 24 is provided to control the generator system. The GCU 25 as shown in FIG. 1 has been greatly simplified to only include those elements that directly relate to the operation of a confidence check circuit.

Included in the GCU 24 are a group of condition sensors indicated generally at 25 which include: an over voltage sensor 26, an under voltage sensor 28, an over frequency sensor 30, an under frequency sensor 32, an under speed sensor 34 which responds to a signal from the constant speed drive 12, an over current sensor 36, and a differential current sensor 38 which measures the difference in current between the generator and the line contactor for each output on lines 18A, 18B and 18C. The condition sensors 25 receive inputs from the generators over lines 18A, 18B and 18C and the underspeed sensor 34 receives an input from the constant speed drive 12 over line 40. Connected to the condition sensors on lines 42OV, 42UV, 42OF, 42UF, 42US, 42OC and 42DC is a test logic circuit 44. A logic diagram of a built-in test logic circuit 44 is provided in FIG. 2. It is the function of the test logic 44 to respond to logic signals from the conditions sensors 25 over the lines 42 and activate or trip an appropriate failure indicator. A group of failure indicators, indicated generally at 46, includes a failed GCU indicator 48, a failed CSD indicator 50, a failed GLC (generator line contactor) indicator 52, and a failed generator indicator 54. The failure indicators 46 are connected to the test logic by means of lines 56FGCU, 56FCSD, 56FGLC and 56FGEN and logic signals from the built-in test logic 44 are transmitted over the lines 56 in order to trip the appropriate failure indicator 46 in response to an out of tolerance condition in the generator system as sensed by the condition sensors 25.

Also included in the GCU 24 is a generator control relay (GCR) 58. The primary function of the generator control relay 58 is to disconnect the exciter field from the voltage regulator by means of signals from the test logic. The position of the GCR 58 is utilized as an input to the test logic over line 60 and the test logic 44 will also serve to trip the GCR 58 when any of the protective functions as indicated by the failure indicators 46 are tripped thereby serving to disconnect the exciter field from the generator in the event of a failure.

In order to test the built-in test logic 44 and the condition sensors 25 a confidence check circuit 62 is also included in the GCU 24. The confidence check circuit 62 receives inputs from the test logic 44 over lines 56 which indicates the condition of the failure indicators. In addition the status of the generator line contactor (GLC) 20 is utilized as an input to the confidence check circuit 62 over line 64 as well as the position of the GCR 58 over line 60. In the event that the correct failure indicator 46 has been activated for the condition being checked, a reset pulse is transmitted from the confidence check circuit 62 to the test logic 44 over line 66. One of the functions of the confidence check circuit is to apply a check signal to each of the condition sensors 25. This is accomplished utilizing lines 68OV, 68UV, 68OF, 68UF, 68US, 68OC, and 68DC.

Figure 2:
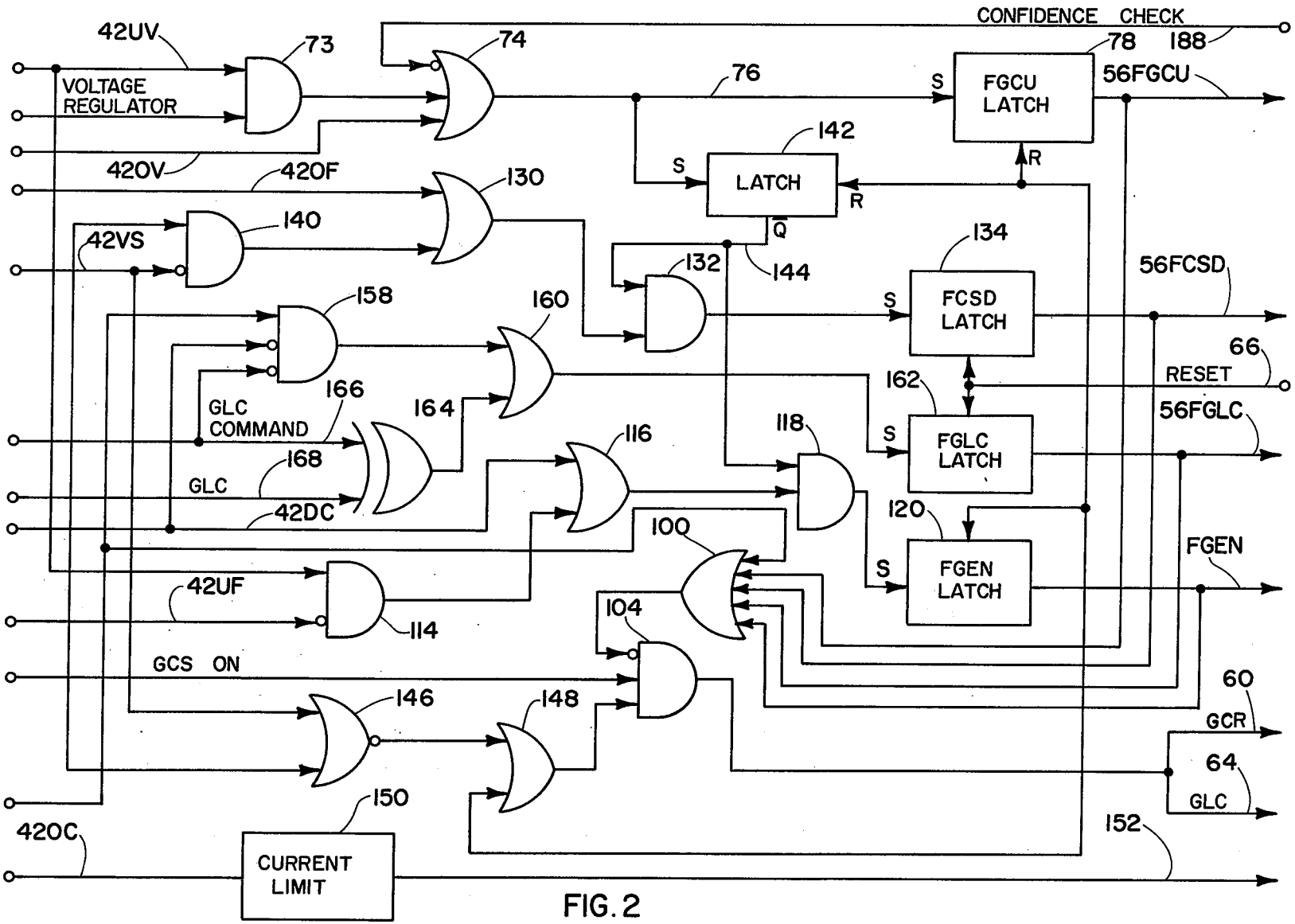
FIG. 2 is a logic diagram of the test logic for the built-in test system of FIG. 1.
Figure 3:
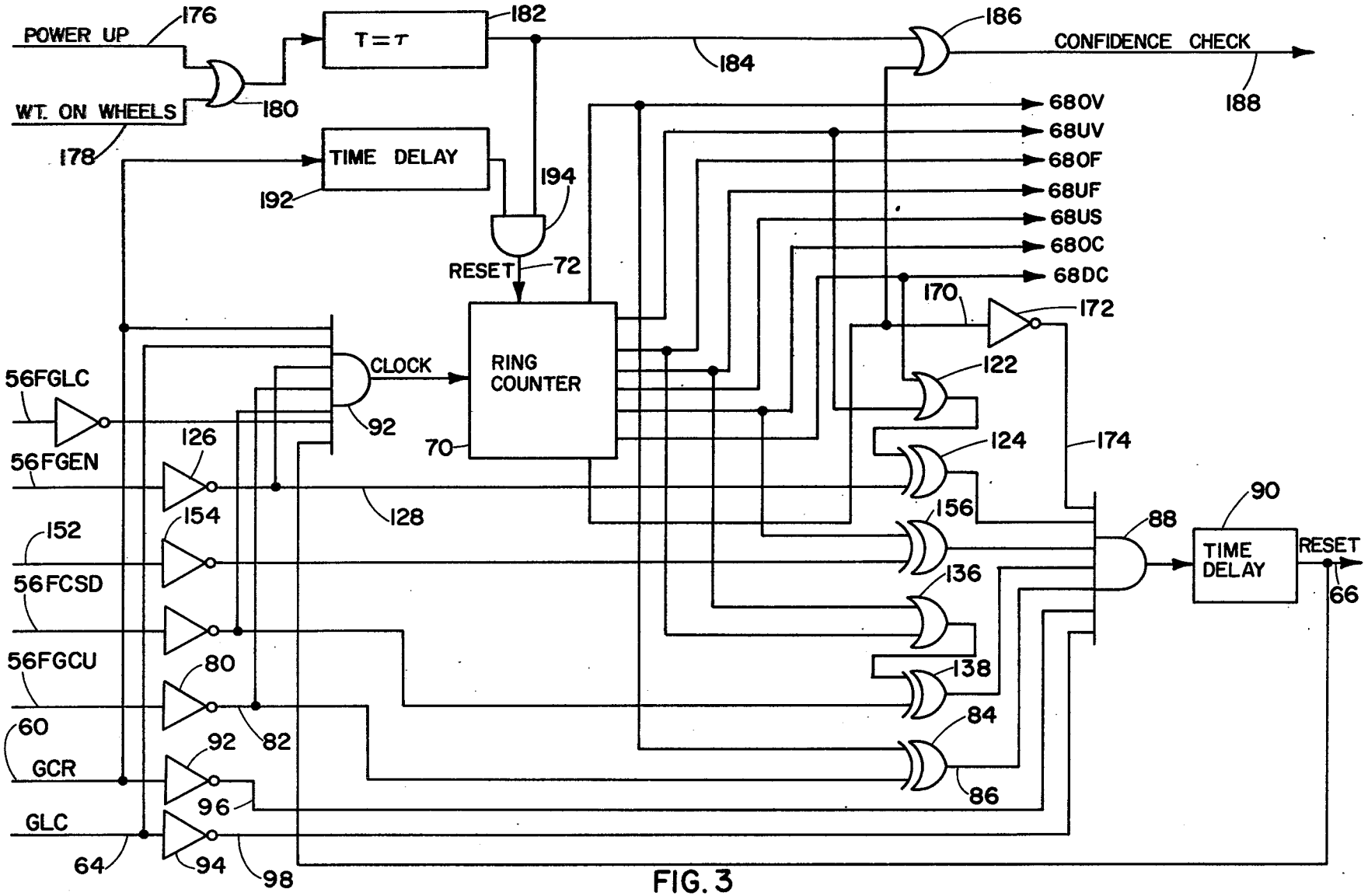
FIG. 3 is a logic diagram of the confidence check circuit for the system of FIG. 1.

A description of the operation of the confidence check circuit 62 will be provided with reference to the test logic diagram of FIG. 2 and the confidence check circuit of FIG. 3. As shown in FIG. 3 the confidence circuit includes a ring counter 70. When the ring counter is reset or initialized by a reset signal applied on a line 72 a first check signal will be generated on line 68OV. The high logic signal applied to line 68OV will cause an over voltage to be applied to the over voltage condition sensor 26 of FIG. 1. If the over voltage condition sensor 26 is operating correctly a high logic signal will be transmitted over line 42OV to the test logic 44. As shown in FIG. 2 a high signal on line 42OV will be transmitted through OR gate 74 on line 76 to a set terminal of a failed GCU latch 78. The failed GCU latch 78, which can be implemented as a RS flip-flop, then generates a high signal on line 56 FGCU. The high signal on line 56FGCU is inverted by an inverter 80 in the confidence check circuit of FIG. 3 wherein the resulting low signal is applied over line 82 to one terminal of an EXCLUSIVE OR gate 84. Another input to the EXCLUSIVE OR gate 84 is the high signal on the line 68OV. Since at this point in time 68OV is high and line 82 is low, the output of the EXCLUSIVE OR gate 84 on line 86 switches from a low state to a high state. Line 86 is connected to the input of an AND gate 88 which in turn is connected to a time delay circuit 90. As will be discussed in detail later the other inputs to the AND gate 88 will all eventually be in a positive logic condition thereby permitting the change of state of the EXCLUSIVE OR gate 84 from 0 to 1 to generate a reset pulse on line 66. The reset pulse on line 66 accomplishes two basic tasks. First, it resets the failed GCU latch 78 in FIG. 2 and secondly, it is applied to an AND gate 92 that serves to generate a clock signal for the ring counter 70. It is preferable to implement the failed GCU latch 78 utilizing NOR logic so that the latch can be reset while there is still a set signal being applied on line 76. For the proper operation of the AND gate 88 the GCR signal on line 60 and the GLC signal on line 64 are in a normally high logic state. These signals are then inverted by inverters 92 and 94 respectively and applied over lines 96 and 98 to AND gate 88. After the failed GCU latch 78 has been set by a logic signal on line 76 the high signal on line 56 FGCU will be applied to an OR gate 100 in FIG. 2 which in turn transmitts this signal by means of line 104 to an inverting gate of an AND gate 104. Since the other put inputs to the AND gate 104 are normally high, the application of the logic signal on line 102 will serve to switch the output of AND gate 104 to a low condition which results in the signals on lines 96 and 98 going high. As a result, the high signals on lines 86, 96 and 98 cause the AND gate 88 to apply a pulse to the time delay circuit 90. It is the function of the time delay circuit 90 to maintain the time duration of the reset pulse on line 66 a predetermined amount of time.

To briefly summarize the operation of the confidence check circuit 62 with respect to the first check signal on line 68OV, if the over voltage sensor 26 and the test logic 44 including the failed GCU latch 78 operate correctly, the AND gate 88 will be enabled thereby resulting in a reset pulse on line 66. Specifically the setting of the failed GCU latch 78 will cause the GCR and GLC signals on line 60 and 64 to go low resulting in the transmission of a high signal through an AND gate 88 thereby initiating the reset signal on line 66. When the reset signal on line 66 has reset the failed GCU latch 78 the signals on line 60 and 64 will again go high thereby enabling the AND gate 92 since at this point the time delayed reset signal is still on line 66 and as a result a clock pulse is transmitted to the ring counter 70 thus incrementing it to the next check signal.

Figure 4:
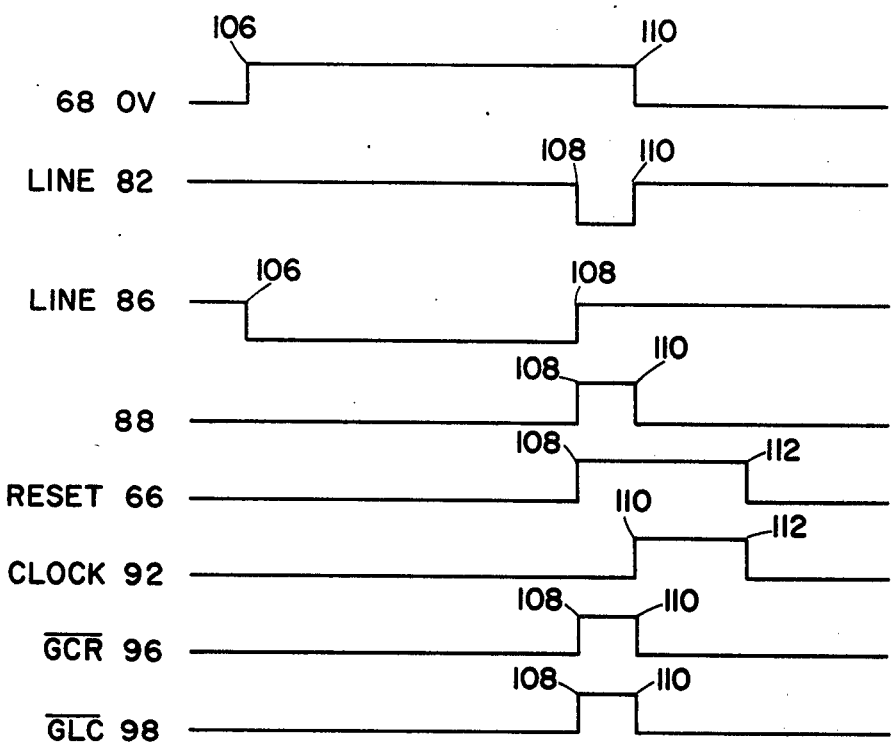
FIG. 4 is a timing chart illustrating the sequence of operation of one step of the confidence check circuit of FIG. 3.

This sequence of operations with respect to the first check signal on line 68OV is further illustrated in the timing chart of FIG. 4. Point 106 on the graph of the signal on line 68OV represents the point in time that the OV check signal is generated. If the over voltage sensor 26 and the test logic 44 are operating normally, there will be a time delay from point 106 until point 108 as shown on the 56 FGCU signal which represents the point in time when the failed GCU latch 78 is set. As illustrated in the signal for line 86, at the point in time represented by 106 the output of the EXCLUSIVE OR gate 84 will go low. This is due to the fact that while the signal on line 82 is high, the high signal on line 68OV will cause the EXCLUSIVE OR gate 84 to output at a low logic signal on line 86. When the failed GCU latch 78 is set the change in state of the FGCU signal on line 82 will cause the EXCLUSIVE OR gate 84 to restore the high signal on line 86. Because the setting of the failed GCU latch 78 also causes high signals on lines 96 and 98 at point 108, the output of AND gate 88 will also switch to a high state as indicated by line 88 of FIG. 4. This will immediately trigger the reset pulse on line 66 resulting, after a short delay, in the resetting of the failed GCU latch 78 as shown at point 110 of FIG. 4. The resetting of failed GCU latch 78 also causes the $\overline{GCR}$ and $\overline{GLC}$ signals on lines 96 and 98 to go low turning off AND gate 88. However, the high signals on line 60 and 64 will result in a clock pulse from AND gate 92 switching the signal on line 68OV into a low state. When the time delayed reset signal on line 66 goes low as indicated at point 112 of FIG. 4 the clock pulse from AND gate 92 will go low. It should therefore be apparent from the foregoing detailed explanation of operation of the confidence check circuit and in particular the failure verification logic shown in FIG. 3 of which elements 84, 88, 90 and 92 form a portion, that a failure in the condition sensor 26 or of any of the built in test logic of FIG. 2 will prevent the generation of a clock pulse to the ring counter 70. Thus, if there is a failure in the built-in test logic the ring counter 70 will remain indefinitely in the particular stage that it happens to be in when the failure is detected.

In order to gain a fuller understanding of the operation of the confidence check circuit, the effects of the other check signals on line 68 will be discussed. When the ring counter 70 increments to the next step, a check signal will be applied to line 68UV. Assuming that the under voltage condition sensor 28 of FIG. 1 operates correctly a high signal will be transmitted on line 42UV through an AND gate 114, an OR gate 116 and an AND gate 118 to a failed generator latch 120. The check signal on line 68UV also is transmitted through an OR gate 122 of the verification logic of FIG. 3 to one input of an EXCLUSIVE OR gate 124. The other input of the EXCLUSIVE OR gate 124 is the 56FGEN signal inverted by an inverter 126 on line 128. The combination of the two high logic signals on the inputs to EXCLUSIVE OR gate 124 will cause the output applied to AND gate 88 to go low. As the failed generator latch 120 is set the GCR and GLC signals on line 60 and 64 will go low resulting in high logic inputs on lines 96 and 98 of AND gate 88. This will result in the triggering of the reset signal on line 66 and the incrementing of the ring counter 70 to the next sequential step in the confidence check.

The next check signal will be applied on line 68OF to the over frequency condition sensor 30 of FIG. 1. If the over frequency condition sensor 30 is operating correctly, a high logic signal will be applied on line 42OF which in turn is transmitted through an OR gate 130 and an AND gate 132 to a failed CSD latch 134. If the circuit elements in FIG. 2 operate correctly, a high logic signal will be applied to line 56FCSD. The high signal on line 68OF is also transmitted through an OR gate 136 in the verification logic of FIG. 3 to one input of an EXLCUSIVE OR gate 138. This signal will then cooperate with the high signal on line 56FCSD to switch the output of the EXLCUSIVE OR gate 138 to a low state. Again, the setting of the failed CSD latch 134 will cause the GCR and GLC signals on line 60 and 64 to go low thereby enabling the AND gate 88 resulting in a reset pulse on line 66. The reset pulse will of course result in the signals on line 60 and 64 going high thereby clocking the ring counter 70 to the next check signal in the confidence checking sequence.

An under frequency check signal on line 68UF will result, if the under frequency condition sensor 32 is operating correctly, in a high logic signal on line 42UF. An under frequency signal on line 42UF will be transmitted through an AND gate 140 to the failed CSD latch 134. The operation of the failure verification portion of the confidence check circuit of FIG. 3 will be the same as the above described operation for the over frequency check. It should be noted at this point that the failed CSD latch 134 and the failed generator latch 120 are inhibited by means of a latch 142 whenever the failed GCU latch 78 has been set by an under voltage condition on line 42UV. The inverted output of latch 42 is transmitted on line 144 to AND gates 132 and 118 to inhibit those gates when the latch 142 has been set.

When the ring counter 70 has been incremented to the next step, an under speed condition check signal is applied to line 68US. If the under speed condition sensor 34 of FIG. 1 is operating correctly a high logic signal will be applied to line 42US. This portion of the confidence check operates somewhat differently in that a failure indicator latch is not set as is the case for the foregoing confidence check. A high signal on line 42US will cause a NOR gate 146, also connected to line 42UF, to transmit a low logic signal through an OR gate 148 to the AND gate 104. This will have the effect of placing a high signal on lines 96 and 98 resulting in the triggering of a reset pulse on line 66. The reset pulse on line 66 will be transmitted through OR gate 148 having the effect of turning on the GCR and GLC signals on line 60 and 64 respectively thus clocking the ring counter 70 to the next stage in the confidence check.

The next stage in the confidence check is the placing of an over current check signal on line 68OC to cause the overcurrent sensor 36 of FIG. 1 to place a high logic signal on line 42OC. A high signal on line 42OC will cause a current limit latch 150 to set resulting in a high signal being transmitted on line 152 to an inverter 154 in the verification logic of FIG. 3 that applies a low signal to an input of an EXCLUSIVE OR gate 156. The low signal from inverter 154 in combination with the high signal from 68OC will cause the EXCLUSIVE OR gate 156 to input a high signal to the AND gate 88. The high signal on line 42OC is also transmitted through an OR gate 100 of FIG. 2 and through an AND gate 100 to cause the GCR and GLC signals on line 60 and 64 to go low thus resulting in the generation of the reset signal on line 66. The reset signal on line 66 will cause the ring counter 70 to increment to the next stage of the confidence check. The termination of the check signal on line 68OC will cause the current limit detector 150 to reset to a low state. The proper state of the generator line contactor 20 as shown in FIG. 1 is checked by means of an EXLCUSIVE OR gate 164. If the GLC command signal on line 166 differs from the GLC state signal on line 168 the failed GLC latch will be set.

The seventh stage in this particular embodiment of the confidence check circuit results in the placing of a differential current signal on line 68DC. If the differential current sensor 38 of FIG. 1 is operating correctly a high signal will be placed on line 42DC. This signal is then transmitted through OR gate 116 and AND gate 118 to set the failed generator latch 120. The resulting high signal on line 56FGEN cooperates with the verification logic of FIG. 3, specifically EXCLUSIVE OR gate 124 and the inverted GCR and GLC signals on lines 96 and 98 respectively, to trigger a reset pulse on line 66 thereby checking for the proper operation of the differential current condition sensor 38 and the test logic of FIG. 2.

After completing the above described seven stages of the confidence check, the ring counter 70 will be incremented to the eighth stage which results in the placing of a high signal on line 170. The signal on line 170 is utilized as an input to an inverter 172 that results in a low signal on line 174 serving to inhibit AND gate 88 when the ring counter 70 has reached the eighth and final stage of the confidence check.

Also included in the confidence check circuit of FIG. 3 are timing elements. For example, the confidence check circuit can respond to a number of initiating signals. A generator power up signal on line 176 or a weight on wheels signal on line 178, for an aircraft application are examples of signals that can be utilized to initiate the confidence check. Taking the weight on wheels signal 178 as an example, this signal is transmitted through an OR gate 180 to a one shot multivibrator having a pulse duration T equal to a time constant $\tau$. The output of the multivibrator 182 is then applied by means of line 184 to a first input of an OR gate 186. A second input of the OR gate 186 is the output of the last stage of the ring counter 70 on line 170. The confidence check output of OR gate 186 on line 188 will normally be high. However, if the time duration of the output of the multivibrator is exceeded and the ring counter 70 has not reached the eighth stage, the signal on line 188 will go low. The resulting low signal on the confidence check line 188 is transmitted through an inverting input to OR gate 74 resulting in the setting of the failed GCU latch. Therefore it can be appreciated that if the confidence check circuit of FIG. 3 fails to go through each stage within the time period $\tau$ the failed GCU latch will be set thereby indicating that there is a failure somewhere in the generator control unit. By determining in which stage confidence check stopped, the exact cause of the failure can be ascertained fairly rapidly.

Figure 5:
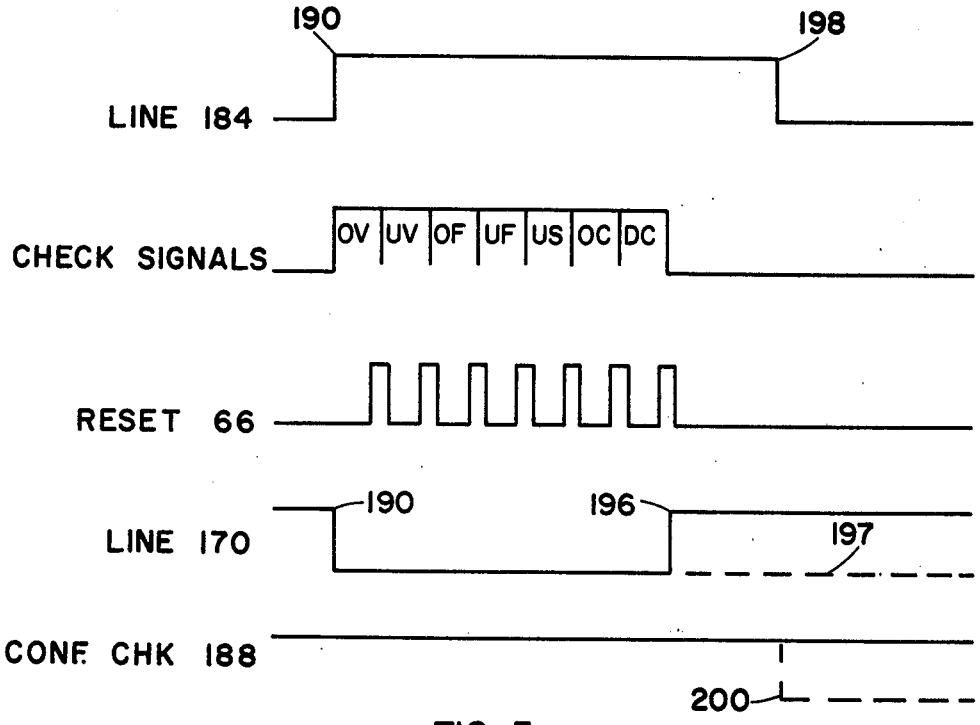
FIG. 5 is a timing chart illustrating the overall operation of the confidence check circuit of FIG. 3.

A timing chart of the overall operation of the confidence check circuit of FIG. 3 is provided in FIG. 5. The initiation of the confidence check is begun at point 190 as shown in the representation of the signal on line 184 in FIG. 5. The initial signal on line 182 of FIG. 3 also cooperates with the GCR signal on line 60 transmitted through a time delay circuit 192 as inputs to an AND gate 196 for resetting the ring counter 70 to the first stage of the confidence check. As shown in the check signal line of FIG. 5 each of the check signals is generated in sequence. If the confidence check system and the test circuit of FIG. 2 are operating correctly the reset signals will occur as shown on the reset line 66. By the same token the signal on line 170 will go low and remain low until the last reset signal is generated at point 196 whereupon the ring counter 70 of FIG. 3 will be in the last stage and the signal on line 170 will go high. In the event that ring counter 70 does not complete the entire sequence the signal on line 170 will remain low as indicated by the dashed line 197. As indicated on the confidence check line 188 of FIG. 5 the confidence check signal will normally remain high throughout the confidence check. However, in the event that there is a failure and the signal on line 184 times out at point 198 the confidence check signal will go low as indicated by the dashed lines 200.

Although the preferred embodiment of the invention has been disclosed and discussed in the terms of a confidence check circuit for use with a generator control system it is apparent that the basic concepts disclosed herein may be used with a wide variety of other types of systems.

I claim:

1. A confidence check circuit for use with a built-in test system or the like having a plurality of condition sensors, test logic circuitry and a plurality of failure indication means, comprising:

a sequential check signal generator, operatively connected to the condition sensors, for sequentially applying a check signal to the condition sensors;

failure verification means, operatively connected to the sequential check signal generator and the failure indication means, for generating a reset signal when each of said check signals results in the activation of a predetermined failure indicator; and incrementing means, responsive to said reset signal, for incrementing said sequential check signal generator.

2. The circuit of claim 1 additionally including a timing circuit operatively connected to said sequential check signal generator for generating a test system failure signal if said sequential check signal generator has not generated a predetermined number of check signals within a predetermined time.

3. The circuit of claim 1 wherein said sequential signal generator is a ring counter.

4. The circuit of claim 1 wherein said failure verification means includes a first verification logic circuit connected to said sequential check signal generator and responsive to a first one of said check signals and operatively connected to a first one of the failure indication means wherein said first failure indication means is normally responsive to said first check signal and wherein said incrementing signal is generated if said first failure indication means is activated by said first check signal.

5. The circuit of claim 4 wherein said first verification logic circuit includes an EXCLUSIVE OR gate.

6. The circuit of claim 4 wherein said first verification logic circuit is additionally responsive to a second one of said check signals wherein said incrementing signal is generated if said first failure indication means is activated by said first or said second check signal.

7. The circuit of claim 1 wherein said failure verification means includes reset logic for applying a reset signal to the failure indicators.

8. The circuit of claim 7 wherein said incrementing means is operatively responsive to said reset signal and the failure indicating means.

9. The circuit of claim 8 wherein said incrementing means includes an AND gate operatively responsive to said reset signal and the failure indicating means.

10. The circuit of claim 8 wherein said failure verification means includes a time delay circuit for increasing the time duration of said reset signal.

11. The circuit of claim 1 wherein said failures verification means includes an inhibit circuit responsive to a last one of said check signal for inhibiting said reset signal.

12. The circuit of claim 11 wherein said inhibit circuit includes an AND gate responsive to said last check signal and the failure indicating means.

13. The circuit of claim 2 wherein said timing circuit includes a pulse generating circuit for generating a timing pulse with said predetermined time duration responsive to a test initial signal; and a logic circuit responsive to said timing pulse and said sequential check signal generator for generating said failure signal.

14. The circuit of claim 13 wherein said logic circuit includes an OR gate and is responsive to a last one of said check signals.

15. The circuit of claim 13 wherein said sequential check signal generator is operatively responsive to said pulse generator and said timing pulse is effective to reset said check signal generator to a first one of said check signals.

16. A confidence check circuit for use with a built in test system or the like having a plurality of condition sensors, test logic circuitry and a plurality of failure indicators comprising:

a ring counter operatively connected to the condition sensors, effective to sequentially apply a check signal to the condition sensors;

a failure verification logic circuit, operatively responsive to said ring counter and said failure indicators, effective to apply a reset signal to the failure indicators if a predetermined failure indicator has been activated by a predetermined check signal;

a clock circuit operatively responsive to said reset signal and the failure indicators, for incrementing said ring counter;

an inhibit circuit responsive to a last one of said check signals for inhibiting said rest signal; and a timing circuit, including a pulse generator for generating a pulse having a predetermined duration responsive to a test initiate signal, operatively to said ring counter for generating a test system failure signal if said ring counter is not incremented a predetermined number of steps within said pulse duration.

17. The circuit of claim 16 wherein said failure verification means includes a first verification logic circuit connected to said ring counter and responsive to a first one of said check signals and operatively connected to a first one of the failure indication means wherein said first failure indication means is normally responsive to said first check signal and wherein said incrementing signal is generated if said first failure indication means is activated by said first check signal.

18. The circuit of claim 17 wherein said first verification logic circuit includes an EXCLUSIVE OR gate.

19. The circuit of claim 17 wherein said first verification logic circuit is additionally responsive to a second one of said check signals wherein said incrementing signal is generated if said first failure indication means is activated by said first or said second check signal.

20. The circuit of claim 16 wherein said failure verification logic includes a time delay circuit for extending the duration of said reset signal a predetermined amount of time.

21. The circuit of claim 17 wherein said clock circuit includes an AND gate operatively responsive to said delayed reset signal and said failure indicators, effective to generate a clock pulse when said delayed reset pulse is on and said failure indicators have been reset.

22. The circuit of claim 21 wherein said verification logic includes an AND gate, responsive to said check signals and the failure indicators, for applying a reset pulse to said time delay circuit.

23. The circuit of claim 16 wherein said timing circuit includes an OR gate operatively responsive to said pulse generator and a last of said check signals, effective to generate said test system failure signal if said last check signal does not occur before said pulse duration terminates.

24. The circuit of claim 16 wherein said ring counter includes a reset circuit operatively connected to said timing circuit and responsive to said pulse to reset said counter to a first of said check signals.

25. A confidence check circuit for use with a built-in test system or the like having a plurality of failure indication means, condition sensors, and test logic, comprising:

a ring counter, operatively connected to the condition sensors, effective to sequentially apply check signals to the condition sensors;

a failure verification circuit including at least one logic gate operatively connected to a predetermined failure indicator and a first predetermined output of said ring counter for generating a reset signal when a said failure indicator is activated in response to a first check signal on said first predetermined ring counter output;

a clock circuit including a logic gate operatively connected to said predetermined failure indicator and responsive to said reset signal to increment said ring counter;

an inhibit circuit operatively connected to said ring counter and said failure verification circuit effective to inhibit said reset signal when said ring counter has been incremented to a predetermined last output; and a timing circuit, including a pulse generator for generating a pulse having a predetermined duration in response to a test initiate signal and a logic gate, operatively connected to said last output of said ring counter, effective to generate a failure signal if said predetermined time duration is exceeded before said last output occurs.

* * * * *